US008760315B2

(12) United States Patent
Williamson et al.

(10) Patent No.: US 8,760,315 B2
(45) Date of Patent: Jun. 24, 2014

(54) SYSTEM AND METHOD FOR EXPANDING PREEMPTION AND BUS PRIORITY SIGNALS

(75) Inventors: William A. Williamson, Thousand Oaks, CA (US); William Thomas Williamson, legal representative, Reno, NV (US); Jarrid Michael Gross, Arvado, CO (US); Jonathan Youngman, Acapulco (MX)

(73) Assignee: E-Views Safety Systems, Inc., Agoura Hills, CA (US)

( * ) Notice: Subject to any disclaimer, the term of this patent is extended or adjusted under 35 U.S.C. 154(b) by 75 days.

(21) Appl. No.: 12/876,978

(22) Filed: Sep. 7, 2010

(65) Prior Publication Data

US 2011/0109478 A1 May 12, 2011

Related U.S. Application Data

(60) Provisional application No. 61/240,182, filed on Sep. 4, 2009.

(51) Int. Cl.
*G08G 1/07* (2006.01)

(52) U.S. Cl.
USPC ..... 340/916; 340/906; 340/917; 340/918; 361/737; 439/629; 439/630

(58) Field of Classification Search
USPC ..... 340/910, 907, 906, 9.1, 12.31, 916, 340/917, 918; 361/737; 439/629, 630
See application file for complete search history.

(56) References Cited

U.S. PATENT DOCUMENTS

| | | | | |
|---|---|---|---|---|
| 4,496,943 | A * | 1/1985 | Greenblatt | 379/93.17 |
| 5,214,757 | A * | 5/1993 | Mauney et al. | 715/751 |
| 7,327,280 | B2 * | 2/2008 | Bachelder et al. | 340/906 |
| 2007/0096943 | A1 * | 5/2007 | Arnold et al. | 340/907 |
| 2008/0263544 | A1 * | 10/2008 | Amano et al. | 718/1 |

OTHER PUBLICATIONS

"NEMA TS 2-2003—Traffic Controller Assemblies with NTCIP Requirements—Version 02.06", pp. 36-134 and 205-212.

* cited by examiner

*Primary Examiner* — Daniel Wu
*Assistant Examiner* — Benyam Haile
(74) *Attorney, Agent, or Firm* — Christie, Parker & Hale LLP

(57) ABSTRACT

A system for controlling traffic for allowing passage of an emergency vehicle through an intersection controlled by traffic signals includes an intersection module for transmitting signals for preempting the traffic signals and one or more circuit cards coupled to the intersection module. Each expansion card includes a plurality of contact closures for outputting one or more of the signals for preempting the traffic signals. The intersection module selects an expansion card based on a type of output desired, and further selects one or more contact closures of the selected card for the desired output. The expansion cards allow preempt or vehicle outputs beyond the output that a single card can provide. According to another embodiment, the output expansion is achieved by emulating the communication interface between the intersection module and the traffic signal controller.

16 Claims, 5 Drawing Sheets

102

SYSTEM AND METHOD FOR EXPANDING PREEMPTION AND BUS PRIORITY SIGNALS

CROSS-REFERENCE TO RELATED APPLICATION(S)

This application claims the benefit of U.S. Provisional Application No. 61/240,182, filed Sept. 4, 2009, the content of which is incorporated herein by reference.

This application is also related to U.S. Pat. No. 7,327,280, the content of which is incorporated herein by reference.

BACKGROUND

Circuit cards residing in a card rack of, for example, a NEMA TS2 traffic signal controller are configured for different types of traffic detection. Each card generally has up to four contact closure outputs for communicating with the traffic signal controller. However, it is often necessary to increase the output of each card to more than four outputs. Accordingly, what is desired is a system and method for expanding the output of each card without having to redesign the card. What is also desired is a modular system which allows the expansion of contact closure outputs without additional physical circuit cards to be added to the system.

SUMMARY OF THE INVENTION

According to one embodiment, the present invention is directed to a system for controlling traffic for allowing passage of an emergency vehicle through an intersection controlled by traffic signals. The system includes an intersection module for transmitting signals for preempting the traffic signals, and one or more circuit cards coupled to the intersection module. Each circuit card includes various contact closures for outputting one or more of the signals for preempting the traffic signals. The intersection module is configured to select a circuit card from the one or more circuit cards based on a type of output desired, and further select one or more contact closures of the selected card for the desired output.

According to one embodiment of the invention, the intersection module includes a table storing a list of output signals mapped to addresses of the one or more circuit cards, wherein the intersection module selects the circuit card based on the table. Each of the addresses may include an address of a specific contact closure for the corresponding circuit card.

According to one embodiment of the invention, the intersection module is included in a master circuit card coupled to a traffic signal controller configured to control the traffic signals.

According to one embodiment, the present invention is directed to a system for controlling traffic for allowing passage of an emergency vehicle through an intersection controlled by traffic signals, where the system includes an intersection module for transmitting signals for preempting the traffic signals, and an emulation module coupled to the intersection module for emulating outputs for a plurality of bus interface units, where each of the plurality of bus interface units is configured to communicate with a traffic signal controller controlling the traffic signals.

According to one embodiment of the invention, the emulation module emulates the plurality of bus interface units without requiring a separate circuit card or card rack for each of the plurality of bus interface units.

DETAILED DESCRIPTION

Figure 1:
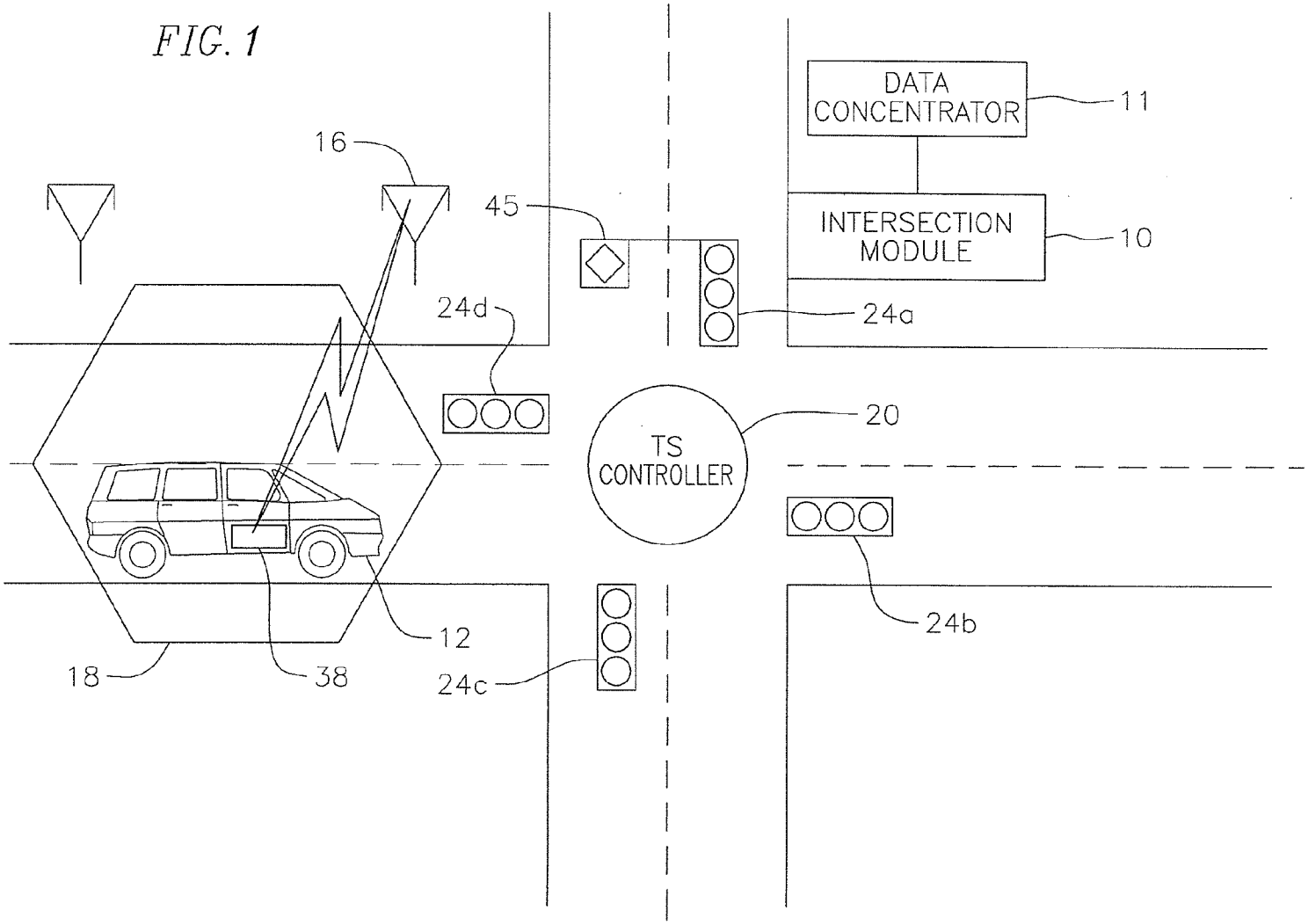
FIG. 1 is a schematic diagram of an intersection subject to preemption according to one embodiment of the invention.

FIG. 1 is a schematic diagram of an intersection subject to preemption according to one embodiment of the invention. Located at the intersection are traffic signal lights 24*a*-24*d* (collectively 24) controlled by a traffic light controller 20, such as, for example, a NEMA TS2 controller. An intersection module 10 coupled to the traffic light controller 20 makes preemption criteria calculations and generates preemption command(s) to give traffic signal priority to an approaching bus or emergency vehicle 12. The intersection module 10 may be a standalone device in a cabinet housing the traffic light controller 20, or be incorporated in a detector card in a detector card rack within the cabinet.

In the illustrated example, traffic signal light 24*d* is controlled by the intersection module 10 to be green while traffic signal lights 24*a*, 24*b*, and 24*c* are controlled to be red, thereby allowing safe passage of the emergency vehicle 12 through the intersection. Pedestrian lights and pedestrian buttons are also controlled to prevent pedestrian traffic through the intersection when the vehicle 12 has the right-of-way.

According to one embodiment of the invention, one or more emergency display panels 45 are activated to provide warning of an approaching emergency vehicle 12 to the surrounding vehicles and pedestrians. According to this embodiment, the display panels 45 are controlled to indicate the approach of the emergency vehicle.

A data concentrator 11 may also be coupled to various intersection modules 10 within a certain geographic area for collecting data from those intersection modules. According to one embodiment of the invention, the data concentrator 11 may be another intersection module 10 equipped with a radio for wirelessly communication with other intersections and approaching vehicles. The data concentrator is further equipped with an Ethernet module for communicating with a central location over a local or wide area data communications network. According to one embodiment of the invention, the data concentrator collects data from various intersection modules and/or vehicles, and forwards the collected data to the central location for logging and generating reports for state and local controllers.

Figure 2:
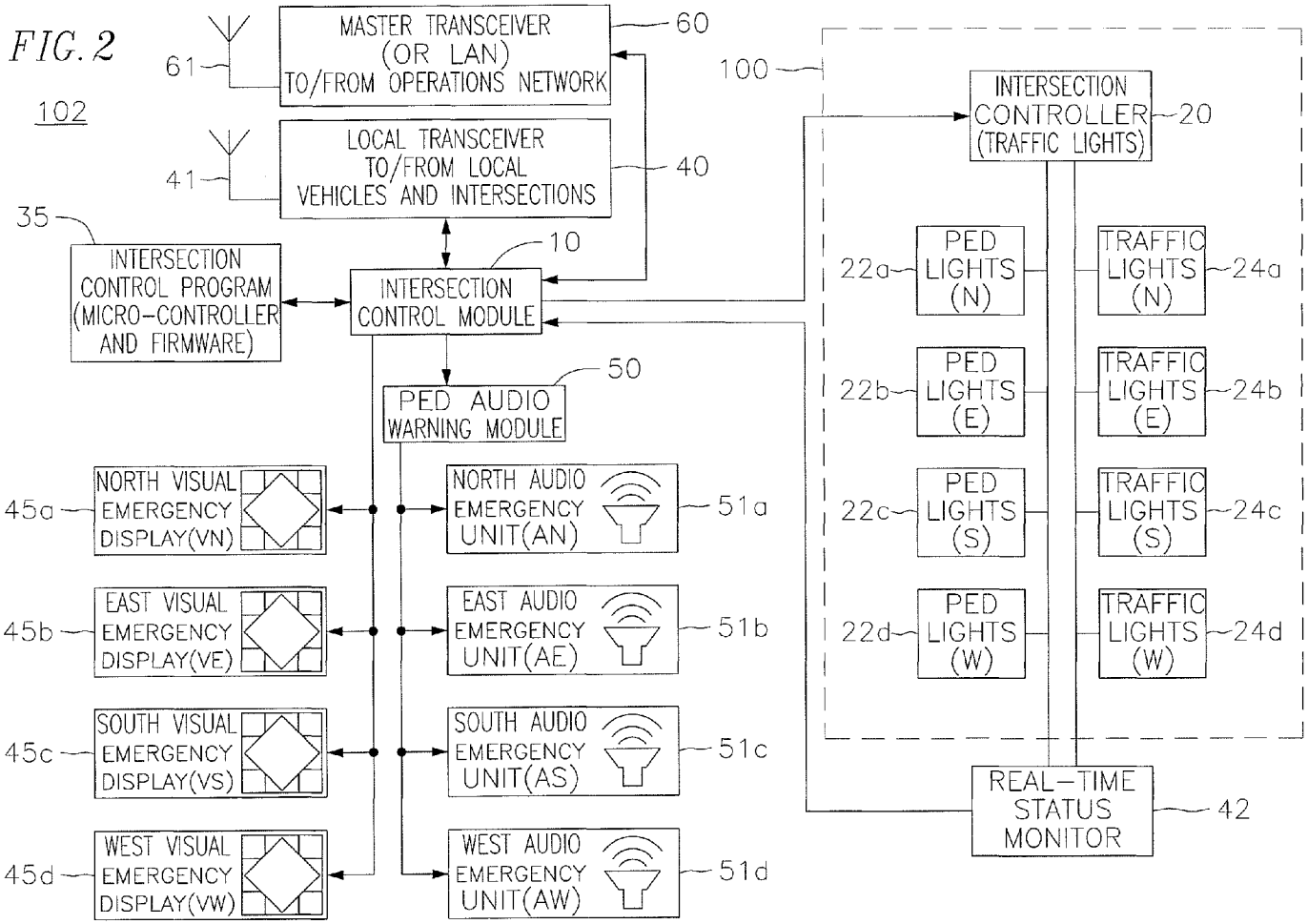
FIG. 2 is a more detailed block diagram of various intersection preemption modules operative for preempting an intersection according to one embodiment of the invention.

FIG. 2 is a more detailed block diagram of various intersection preemption modules 102 operative for preempting an intersection according to one embodiment of the invention. The intersection preemption modules 102 include a traffic light control system 100 including the traffic light controller 20 that controls the traffic and pedestrian signals at the intersection as well as any pedestrian buttons. Specifically, the traffic light controller 20 generates the appropriate sequence of on-time and off-time for the various traffic lights 24*a*, 24*b*, 24*c*, and 24*d* and pedestrian lights 22*a*, 22*b*, 22*c*, and 22*d* that respectively control vehicular and pedestrian traffic at the intersection. The traffic light controller 20 also has the capability to be forced by external signals into a preemption mode that activates "green" lights in a specified direction and "red" lights in all other directions, allowing safe passage for emergency vehicles from the "green" direction. The traffic light controller 20 may be a micro-processing circuit driving isolated lamp drivers but discrete designs are also feasible. Some intersections may be more complicated, controlling turn lanes with arrow lights, but the basic principles remain the same.

The intersection control module 10 coupled to the traffic light controller 20 is a microprocessor operated via an intersection control program 35 stored in memory. The intersection control module 10 receives information from the emergency vehicles 12 approaching the intersection via a radio including a wireless RF transceiver 40 and antenna 41. According to one embodiment of the invention, the radio is a 900 Mhz spread spectrum, multi-channel radio.

According to one embodiment of the invention, the information received by the radio includes data about the predicted position, heading, and/or other navigation data of the emergency vehicle, and/or its priority-code status 36 (i.e. Code-3, Code-2, or other) (collectively referred to as vehicle information).

The intersection control module 10 is further coupled to a real-time status monitor 42 which provides real time status information of the various traffic lights 24*a*-24*d*, pedestrian lights 22*a*-22*d*, and pedestrian buttons. That is, the real-time status monitor receives (i.e., "reads") the output from the traffic light controller 20, pedestrian lights 22*a*-22*d*, and traffic lights 24*a*-24*d*, and transmits the read information to the intersection control module 10. The read information includes, for example, the timing and/or phasing of the traffic and pedestrian lights to allow the intersection control module 10 to monitor the timing of the traffic/pedestrian signal phases to optimize preemption at the intersection.

In order to effectuate preemption at the intersection, the intersection control module 10 performs ETA calculations for the approaching emergency vehicles based on the corresponding vehicle information including predicted vehicle position, heading, and the like. The intersection control module 10 uses the ETA calculations along with the intersection phasing values to optimize preemption at the intersection. That is, the intersection control program makes "time-to-preempt" calculations and "time-to-pedestrian-inhibit" calculations to provide minimal disruption to the normal traffic light controller behavior and to maximize the throughput of emergency vehicles through the intersection. If a conflict is detected, such conflict information is transmitted to the emergency vehicles via the local transceiver 40.

In addition to preempting the traffic signals to give priority to the emergency vehicles, the intersection control module 10 also sends signals to emergency display panels 45*a*, 45*b*, 45*c*, and 45*d* (collectively 45) to light and flash large emergency signs with the proper icons at each corner of the intersection showing the position of any approaching emergency vehicle relative to the traffic lanes of the intersection. The intersection control module further interacts with an audio warning module 50 to generate audio messages for delivery via speakers 51*a*-51*d*.

According to one embodiment of the invention, any information received or generated by the intersection module 10 may be transmitted to a central monitoring system such as, for example, a central traffic or fleet management system, via a master transceiver 61 using antenna 61. The wireless transmission may be over any wireless network including, for example, a cellular network. Alternatively, the transmission may be over a wired data communications network such as, for example, a local area network, wide area network, or the like. All or portion of the information may also be transmitted to the emergency vehicles, other intersections, or the data concentrator 11, via the local transceiver 40.

I. Mesh Networks

Radios are generally equipped with meshing capability so that other radios that are not within radio communications range can still communicate and pass information on to nodes that are outside the normal communications range. One problem of running a mesh network is that there generally is no control of whether a given radio forms part of the mesh network or not. Thus, high priority data that is intended to and from a particular vehicle and intersection module is propagated to other intersection modules and vehicles, saturating the network and consuming aggregate bandwidth.

In a street environment, there are two types of communications over the radio network: (1) vehicle to intersection/intersection to vehicle; and (2) intersection or data concentrator to intersection or data concentrator. According to one embodiment of the invention, nodes involved in the communication between vehicles and intersection modules do not participate in meshing in order to limit radio traffic at times when many emergency vehicles may be in transit locally responding to the same event. By not meshing, only the vehicles and intersections that are in direct communications will utilize the radio network. The radios outside the natural radio range will not be able to "hear" this radio traffic, nor will any node attempt to forward this traffic "mesh" since this information has no value except between vehicles and their local intersections.

Nodes involved in the communication between the intersection module or data concentration to intersection module to data concentrator do utilize meshing in order to allow intersection modules to be managed and interrogated of current status while not having a direct link between a local data concentrator and other intersection modules. Meshing allows data to move through the mesh network as needed in order to ensure distant modules can still be accessed even though the natural radio range has been significantly exceeded.

According to one embodiment of the invention, the meshing of intersection modules and data concentrators may be halted during an emergency event in order to preserve radio network bandwidth for emergency vehicles and intersection modules near to them.

According to one embodiment of the invention, the devices control if a given communication type or packet will engage in meshing via a control mechanism. In this regard, messengering of non-critical information between the data concentrator and intersection module are halted during an emergency. Halting all but critical traffic effectively halts meshing. According to one embodiment of the invention, non-critical messages include priority maintenance uploads and downloads, firmware updates, low priority status monitoring, and the like. In the event that any of these services are halted, the system automatically resumes meshing of those services when that traffic is once again appropriate.

According to one embodiment of the invention, the radio in an intersection module is configured to detect whether an emergency vehicle in an emergency mode is in its preemption segment. In this regard, the emergency vehicle transmits a message indicating its emergency mode. Upon receipt such message, the intersection module refrains from forwarding messages or packets that it may receive from other intersections as such messages are interpreted to be non-emergency messages. The only communication engaged by the intersection module during the emergency mode is with the emergency vehicles. In this manner, bandwidth is conserved to allow faster and more efficient communication with the vehicles.

II. Output Expansion

According to one embodiment of the invention, the intersection module 10 is included in a detector card that is plugged into a card rack provided within a cabinet that houses the traffic signal controller 20. The cabinet may be, for example, a NEMA TS2 cabinet. Alternatively, the intersection module 10 may reside as a stand-alone device in communication with the detector card rack. Cards in the detector card rack may be configured for different types of traffic detection as is conventional in the art. If the card includes the intersection module, the card is further configured to detect presence of emergency vehicles and the like, for intersection preemption.

Cards that are inserted into the card racks generally have up to four contact closure outputs for communicating with the traffic signal controller 20. However, it is often necessary to increase the output of the intersection module 10 to more than four outputs.

According to one embodiment, the output expansion is achieved via one or more expansion modules (boards) that allow preempt or vehicle outputs beyond the output that a single card can provide. According to another embodiment, the output expansion is achieved by emulating the communication interface between the intersection module (card) 10 and the traffic signal controller 20.

A. Output Expansion via Expansion Modules

Figure 3:
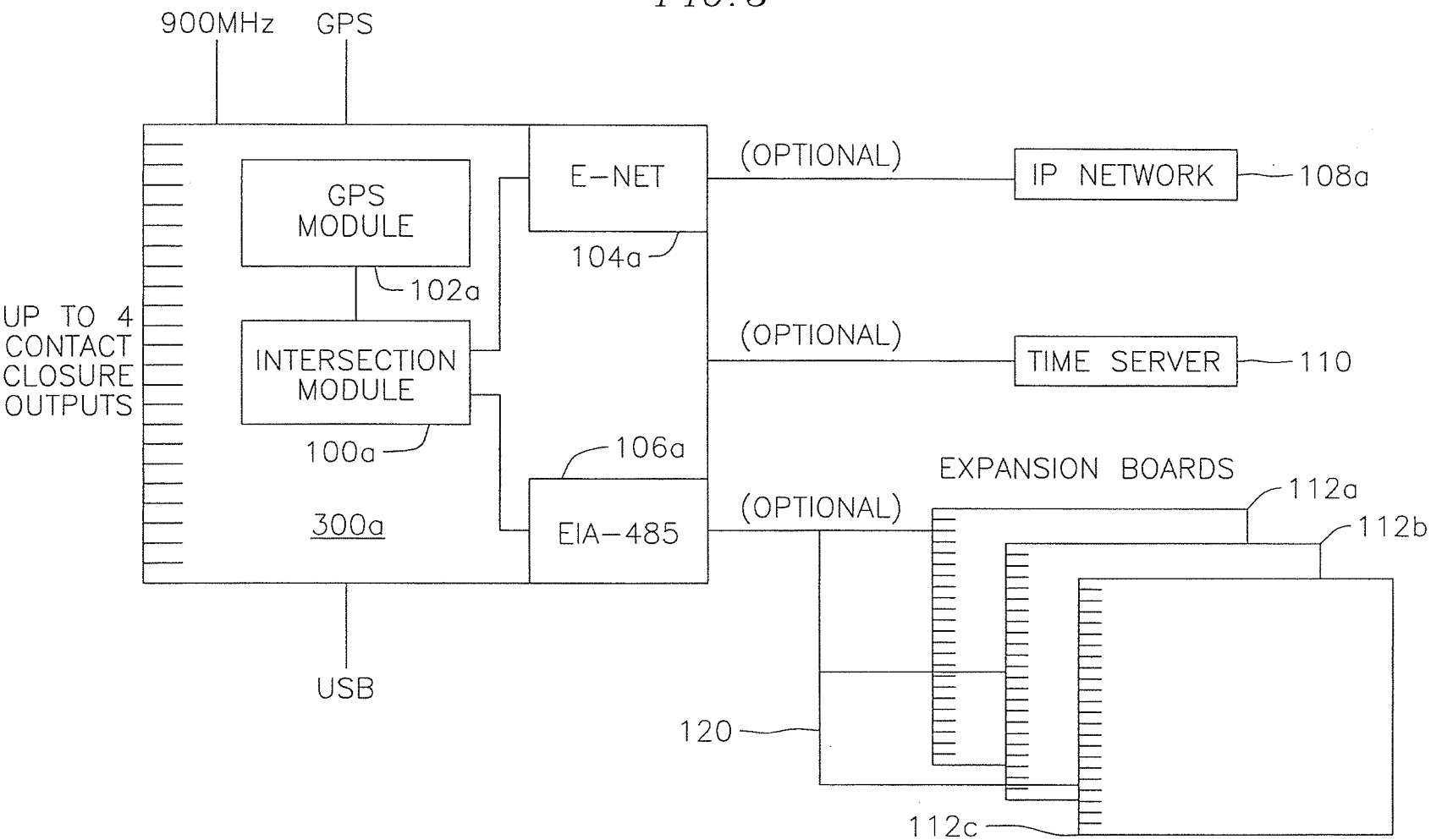
FIG. 3 is a block diagram of master detector card coupled to one or more expansion boards according to one embodiment of the invention.

FIG. 3 is a block diagram of circuit card referred to as a master detector card 300*a* according to one embodiment of the invention. The master card 300*a* includes an intersection module 100*a* which includes hardware (e.g. processor, memory, etc.) and software similar to the hardware and software in the intersection module 10 of FIGS. 1 and 2. The intersection module 100*a* is operated by the intersection control program 35 (FIG. 2) to provide preemption and bus priority signals to the traffic signal controller for preempting the traffic signals for allowing safe passage of an emergency vehicle through an intersection controlled by the traffic signals.

The master card 300*a* further includes a GPS module 102*a* for providing timing information via a time server module 110 as is discussed in further detail below. The master card may also include a data communications interface such as, for example, an Ethernet interface 104*a* for communicating with a central system over a data communications network 108.

According to one embodiment of the invention, the master card may also include a communication module 106 for communicating with one or more expansion cards/boards/modules 112*a*-112*c* (collectively referred to as 112) over cable 120. The communication module 106 may be, for example, an asynchronous serial interface with a EIA-485 physical layer.

According to one embodiment of the invention, each expansion module 112 is similar to the master card 300*a*, except that it preferably does not includes a GPS receiver or radio.

According to one embodiment of the invention, the master card may be configured via a USB PC interface, using a USB device driver that emulates a standard PC serial port (COM). The USB device allows the connection to a PC terminal emulator (hyperterm or ProComm) to allow a text menuing system to navigate status screens, diagnostics and parameter configuration. The information that may be configured includes, but is not limited to:

- Radio Network ID (allows multiple systems to exist without interference)
- Radio Network Hopping Table
- Radio Transmit Power (from 1 mw to 1 watt).
- Meshing tuning controls (max hops, etc.)
- Preemption segment (GPS data for vehicle preemption approaches)
- Preemption virtual output channel for each segment (virtual outputs can be configured to be local card edge contact closures, SDLC frame bit location, or expansion module device address/output position).
- Segment specific tuning parameters (time or distance to intersection when applying virtual output).
- Intersection identity information
- Configuration of output types for each virtual output (as described above).
- Security and protection codes.

According to one embodiment of the invention, each expansion card 112 has an address select switch allowing the master card to address up to 16 separate expansion cards. Each expansion card has up to four contact closure outputs on the card edge for that card. This therefore allows the expansion of up to 64 separate outputs that can be added into a conventional traffic detector card rack.

Each expansion card is assigned a specific address. When the master card seeks to output a certain preempt or vehicle output, it makes reference to a table stored in a memory device of the master card to determine which card should be used for the output, and further, which contact closure of the card should be used for the output. In this regard, the table includes a list of output signals mapped to addresses of physical devices that will provide the outputs. In the embodiment of expansion modules, the addresses are addresses of specific expansion modules as well as a sub-address of a specific contact closure.

Once the master card obtains the address and sub-address of a specific expansion card, the master card transmits a message to the address assigned to the card. The card then responds to the message with a specific output indicated in the message, such as, for example, a solid contact closure, a variable pulse width, or the like. The card maintains its output for as long as the main card 10*a* instructs it to do so, or there has been a communications failure. In the event of a communications failure, the card reverts to a safe, all contact, all open condition. In this manner, the expansion modules allow an expansion of the number of possible outputs without being limited to the four contact closure output allotted to the master card.

According to one embodiment of the invention, the communication module 106 is configured with a communications protocol that allows security and prevents bad communication packets from being interpreted incorrectly which then allows for a safe mechanism for providing additional preempt or vehicle outputs. If communication is non-function, the master card provides a fault condition.

An exemplary table used for the expansion module may be as follows. Where a switch position is "up/on", that bit position will record as a "1" in the table below. Where a switch position is "down/off", that bit position will record as a "0" in the table below. There are 4 bit positions that make up the device address.

Addr setting 0000, device address is 0 (this is dedicated to "remote" outputs 1 to 4).

Addr setting 0001, device address is 0 (this is dedicated to "remote" outputs 5 to 8).

Addr setting 0010, device address is 0 (this is dedicated to "remote" outputs 9 to 12).

Addr setting 0011, device address is 0 (this is dedicated to "remote" outputs 13 to 16).

Addr setting 0100, device address is 0 (this is dedicated to "remote" outputs 17 to 20).

Addr setting 0101, device address is 0 (this is dedicated to "remote" outputs 21 to 24).

Addr setting 0110, device address is 0 (this is dedicated to "remote" outputs 25 to 28).

Addr setting 0111, device address is 0 (this is dedicated to "remote" outputs 29 to 32).

All remaining addresses are for future expansion except 254 and 255 which are for multicast messages for serial devices.

According to one embodiment of the invention, the intersection module 100*a* includes a "Pedestrian/Ped Inhibit Card" device. It functions along with the expansion module on the same interface and provides a mechanism (a serial information packet) that allows the Ped Inhibit card to inhibit pedestrian invoked signaling (a request for a pedestrian walk) that prevents the traffic controller from receiving such signals shortly prior to and during a preemption sequence. This is performed to prevent potential safety conditions should the pedestrian be in the act of crossing the street during an emergency condition. The Ped Inhibit module has no address switches. Multiple modules can be installed in a card rack, replacing a standard Ped Isolator Unit (TEES 242/252 unit). All Ped Isolator modules are commanded as a multicast serial message, to which they act, but do not respond. Accordingly, the Ped Inhibit card provides a useful safety feature.

B. Output Expansion via Communication Interface Emulation

According to another embodiment of the invention, a modular system is provided which allows the expansion of contact closure outputs without additional physical circuit cards to be added to the system as expansion modules. In this regard an embodiment of the present invention provides emulation of a communication interface between the intersection module and the traffic signal controller. Such a communication interface is referred to as a bus interface unit (BIU). The emulation of a BIU allows the replacing of a whole rack of detectors, and the BIU that they connect to.

Typically there will be one BIU installed in its own slot in the card rack, and there will be up to 8 detector card slots, whose outputs are connected to the BIU for transmission to the traffic controller. According to one embodiment, the intersection module 300 "pretends" to be that BIU that can pass pseudo detector information to the controller without having to provide the BIU or the card rack, or the detector cards themselves. According to this embodiment, the intersection module plugs into a card rack, but for power only, and has no direct relationship to the BIU which may be plugged into the same card rack it occupies.

Figure 4:
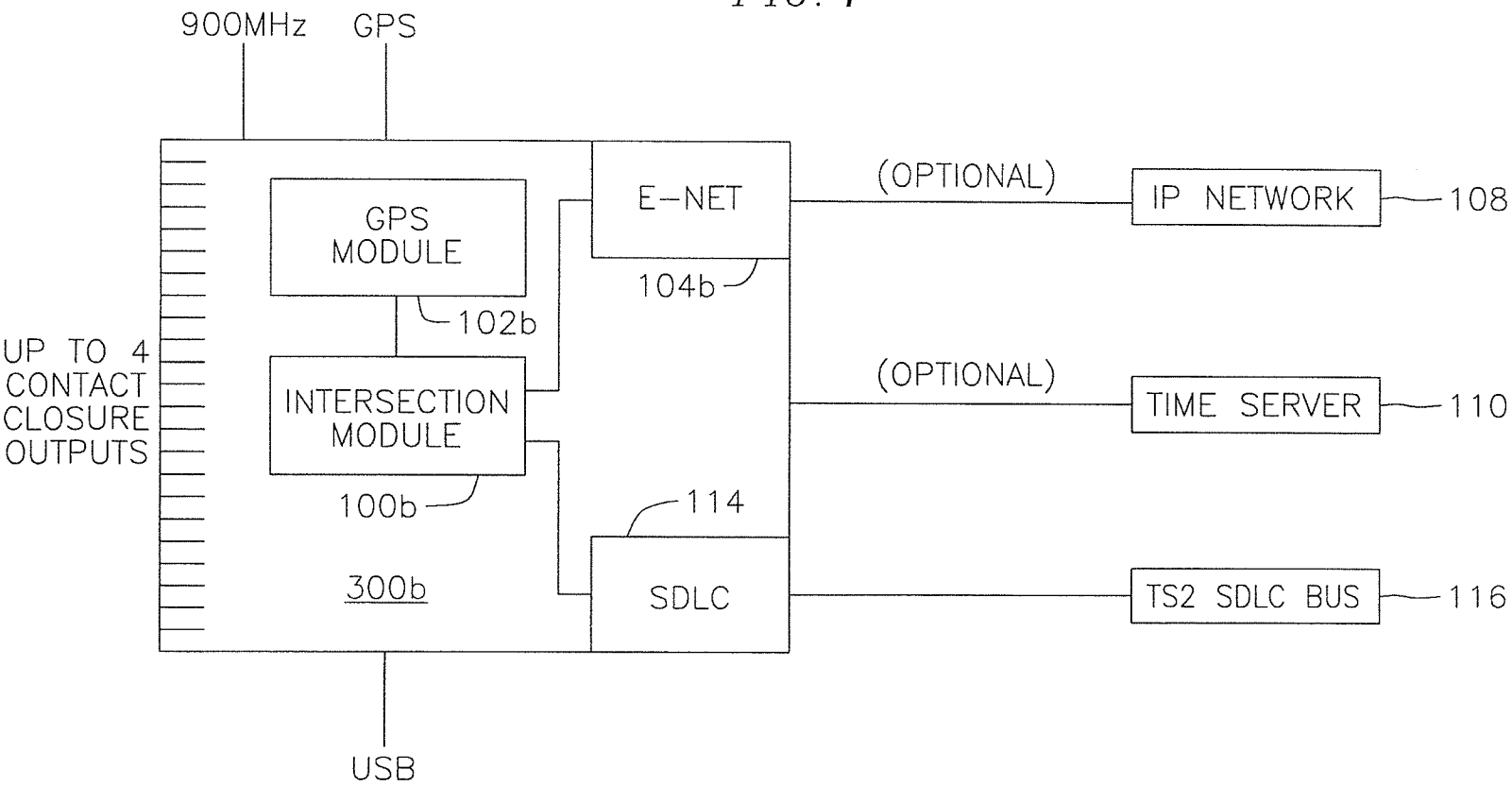
FIG. 4 is a block diagram of master detector card including emulation of various bus interface units according to one embodiment of the invention.

FIG. 4 is a block diagram of a master card 300*b* according to this embodiment of the invention. The master card 300*b* includes an intersection module 100*b*, GPS module 102*b*, Ethernet interface 104*b*, which may be similar to the intersection module 100*a*, GPS receiver 102*a*, and Ethernet interface 104*a* of FIG. 3. The master card 300*b* according to the embodiment of FIG. 4, however, includes a SDLC communication module 114 for interfacing with the traffic signal controller via a communication interface, such as, for example, a synchronous data link control (SDLC) port/interface coupled to bus 116. The SDLC interface is also referred to as a BIU interface. The SDLC interface reads inputs from the card and provides outputs to the traffic controller 20.

According to one embodiment of the invention, the SDLC module 114 (also referred to as an emulation module) emulates one or more SDLC interfaces without requiring adding corresponding BIU card racks providing such interfaces. In this regard, the master card has an "application select" switch allowing up to 16 different applications (application configurations) where various combinations of BIU types (detector or terminal and facilities (TF) BIUS) can be emulated by the SDLC module 114. The card 300*b* specifies which of its virtual output bits it wants true, false, or as a fixed frequency variable pulse width, and those bits are positioned into a relevant SDLC response frame at specific pre-defined bit positions.

According to one embodiment of the invention, when the master card seeks to output a certain preempt or vehicle output, it makes reference to a table to determine which BIU is configured to provide the output as is specified under, for example, the current NEMA TS2 specification, and the SDLC frame that is associated with the BIU. When the traffic signal controller 20 makes a request of information to a specific BIU, the request is sent to the SDLC module 114 via the SDLC bus 116, and the SDLC module 114 emulates the output of the BIU to respond identically to how the BIU would. The emulation is undetectable to the traffic controller. The SDLC module 114 therefore allows a direct interface to existing traffic signal control systems without employing a BIU circuit card and its required card rack. This has the added benefit to a drastic reduction of wiring complexity and system cost, as well as size reduction, as compared to an equivalent system using detector card interfaces with contact closures. That is, the capability of using the SDLC module to interface with a traffic signal controller using its built in SDLC (port 1) interface allows many preempt or transit signal priority without increasing the system complexity or need for additional BIU card racks.

According to one embodiment, the traffic signal controllers have the ability to turn on or off specific BIU services (messages), which allow the controller to be setup for greater or lesser system configurations. Existing BIUs can be left into the system while operating with the SDLC module 114. In this situation, the module 114 does not emulate a BIU already in the system.

If an existing BIU conflicts with a BIU emulated by the TS2 SDLC Module there will be response failures for both the BIU and the emulated BIU that the TS2 traffic controller will detect, and possibly result in an intersection flash condition.

The SDLC card may emulate multiple BIUs. NEMA TS2 defines Terminal and Facilities (TF) 1, 2, 3, 4 with possible extension 5, 6, 7 and 8. NEMA TS2 also defines Detector (DET) 1, 2, 3, 4 with possible extension 5, 6, 7 and 8. This allows up to 16 possible BIUs to be emulated, individually or as a definable series of BIUs.

Figure 5:
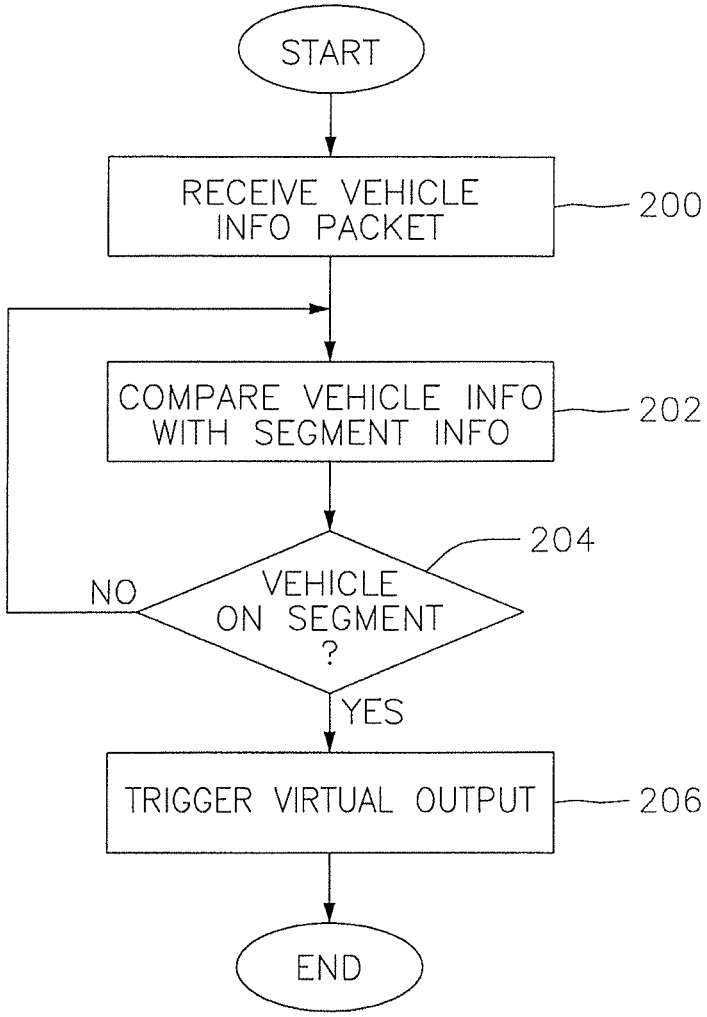
FIG. 5 is a general flow diagram of a process for vehicle preemption signal generation and output according to one embodiment of the invention.

FIG. 5 is a general flow diagram of a process for vehicle preemption signal generation and output. The steps in this process applies to either the embodiment where output is expanded via the expansion modules, or the embodiment including communication interface emulation.

According to the illustrated process, an emergency vehicle that has been placed in a priority-code, outputs its code status, GPS position/heading radio packet, and/or other vehicle information packet to all radios in its range, listening for such types of information.

In step 200, the radio of an intersection module 10*a* receives the vehicle information packet, and in step 202, compares the received position and heading information with its internally programmed segment data.

A determination is made in step 204 as to whether the vehicle is on its preemption segment. If the answer is YES, the intersection module 10*a* calculates an ETA for when the vehicle will arrive at the intersection. As the vehicle gets nearer to the intersection controlled via the intersection module 10*a*, the module triggers, in step 206, one of its outputs based on ETA time, or actual proximity based on programmed segment parameters and Time Of Day, as is discussed in further detail in U.S. Pat. No. 7,327,280.

According to one embodiment of the invention, the output in step 206 is a virtual output that is mapped to a physical device. The physical device may be, for example, a local I/O such as, for example, the contact closure of a local card, a SDLC frame bit location, or an expansion board 112 address/output position.

According to one embodiment of the invention, the status of the virtual output is continually managed whether those outputs are true or false, and the I/O is updated continuously. In this regard, virtual outputs can have output states ranging from false (always off) to true (always on), and variable states of fixed frequency and duty cycle (variable frequency/pulse width).

When a vehicle passes out of the preemption segment, it may enter into other segments repeating the process on other virtual outputs. When the vehicle is no longer in any of the intersection's preemption segments, all virtual outputs revert to a "false" state. Lack of communication between output modules (TS2 SDLC module or expansion cards) results in a timeout, and all outputs are forced to a "false" state for safety.

III. Time Server

According to one embodiment, the master cards 300*a*, 300*b* may further include a time server module 110 for synchronizing a timer in the traffic signal controller 20 with a time provided by the time server module 110. The time is provided by the GPS module 102*a*, 102*b* included in the master card 300*a*, 300*b*.

Traffic controllers typically support one of several time synchronization protocols, some over a serial interface (typically EIA-232), and others over Ethernet LAN (TCP/UDP-IP). The master card may be configured to support one of several serial protocols (AB3418, NTCIP, NMEA time string), or can be configured as a NTP server if optional Ethernet Module is used.

According to one embodiment, the time server module is a software module inside the master card that may be enabled or disabled. The time server may be configured to output its time information at any of 24 configurable hour:minute time, and can be configured to send the time information at power up, upon acquisition of GPS information via the GPS receiver. In this manner, the traffic signal controller is synchronized to provide accurate traffic coordination in conjunction with other adjacent traffic signal controllers.

While the above description contains many specific embodiments of the invention, these should not be construed as limitations on the scope of the invention, but rather as an example of one embodiment thereof. Accordingly, the scope of the invention should be limited by the embodiments illustrated.

The invention claimed is:

1. A system for controlling traffic for allowing passage of an emergency vehicle through an intersection controlled by traffic signals, the system comprising:

a first circuit card configured for insertion into a first card slot of a traffic detector card rack having a plurality of card slots, the first circuit card including an intersection module for transmitting signals for preempting the traffic signals, the first circuit card including a plurality of contact closure outputs and an interface for transmitting a plurality of messages, the traffic detector card rack being a component inside a traffic control cabinet, wherein the intersection module receives power from the detector card rack; and one or more second circuit cards coupled to the first circuit card, each of the one or more second circuit cards including a plurality of contact closures for outputting one or more signals for preempting the traffic signals, each of the second circuit cards configured for insertion into one of the plurality of second card slots in the traffic detector card rack;

wherein, the intersection module is configured to select a circuit card from the one or more second circuit cards based on a type of output desired, and further select one or more contact closures of the selected card for the desired output, and wherein the interface in the first circuit card is configured to transmit a corresponding message to the selected one or more contact closures of the selected circuit card for output.

2. The system of claim 1, wherein the intersection module includes a table storing a list of output signals mapped to addresses of the one or more circuit cards, wherein the intersection module selects the circuit card based on the table.

3. The system of claim 2, wherein each of the addresses include an address of a specific contact closure for the corresponding circuit card.

4. The system of claim 1, wherein the intersection module is included in a master circuit card coupled to a traffic signal controller configured to control the traffic signals.

5. A system for controlling traffic for allowing passage of an emergency vehicle through an intersection controlled by traffic signals, the system comprising:

a circuit card housed inside a housing, the circuit card including logic for:

an intersection module for generating an output for preempting the traffic signals; and an emulation module coupled to the intersection module, wherein the emulation module replaces a traffic detector card rack and an associated bus interface unit (BIU) that are physically absent from the housing, wherein, the intersection module is configured to identify a specific output for controlling the traffic signals, identify at type of the absent BIU configured to provide the specific output, and map the specific output to bit locations of a data frame associated with the absent BIU, wherein, the emulation module is configured to communicate with a traffic signal controller for controlling the traffic signals based on the mapped bit locations.

6. The system of claim 5, wherein the emulation module emulates a plurality of bus interface units without requiring a separate circuit card or card rack for each of the plurality of bus interface units.

7. The system of claim 5, wherein the emulation module is implemented via a synchronous data link control interface on the circuit card.

8. A method for controlling traffic for allowing passage of an emergency vehicle through an intersection controlled by traffic signals, the method comprising:

selecting by an intersection module a circuit card from one or more second circuit cards based on a type of output desired, the intersection module being included in a first circuit card configured for insertion into a first card slot of a traffic detector card rack having a plurality of card slots, the first circuit card including a plurality of contact closure outputs and an interface for transmitting a plurality of messages, each of the second circuit cards being configured for insertion into one of the plurality of second card slots in the traffic detector card rack, wherein the intersection module receives power from the detector card rack;

selecting by the intersection module one or more contact closures of the selected card for the desired output; and transmitting to the selected one or more contact closures of the selected circuit card, via the interface in the first circuit card, a message corresponding to the desired output; and outputting by the selected circuit card via the selected one or more contact closures one or more signals for preempting the traffic signals.

9. The method of claim 8, wherein the intersection module includes a table storing a list of output signals mapped to addresses of the one or more circuit cards, wherein the intersection module selects the circuit card based on the table.

10. The method of claim 9, wherein each of the addresses include an address of a specific contact closure for the corresponding circuit card.

11. The method of claim 8, wherein the intersection module is included in a master circuit card coupled to a traffic signal controller configured to control the traffic signals.

12. A method for controlling traffic for allowing passage of an emergency vehicle through an intersection controlled by traffic signals, the method comprising:

generating by an intersection module implemented via a circuit card housed inside a housing, an output for preempting the traffic signals; and transmitting the output to a traffic signal controller via an emulation module, the emulation module replacing a traffic detector card rack and an associated bus interface unit (BIU) that are physically absent from the housing;

wherein, the intersection module is configured to identify a specific output for controlling the traffic signals, identify at type of the absent BIU configured to provide the specific output, and map the specific output to bit locations of a data frame associated with the absent BIU, and wherein, the emulation module is configured to communicate with the traffic signal controller for controlling the traffic signals based on the mapped bit locations.

13. The method of claim 12, wherein the emulation module is implemented via a synchronous data link control interface on the circuit card.

14. The system of claim 5, wherein the type of BIU is one of a terminal and facilities BIU, or a detector BIU.

15. The system of claim 5, wherein the data frame adheres to a synchronous data link control communications protocol.

16. The system of claim 5, wherein the emulation module is configured to receive a request from the traffic signal controller, and transmit an output to the traffic signal controller emulating an output of the absent BIU.

* * * * *